US011702890B2

(12) United States Patent
Lane et al.

(10) Patent No.: US 11,702,890 B2
(45) Date of Patent: Jul. 18, 2023

(54) EARTH-BORING TOOLS, CUTTING ELEMENTS, AND ASSOCIATED STRUCTURES, APPARATUS, AND METHODS

(71) Applicant: Baker Hughes Oilfield Operations LLC, Houston, TX (US)

(72) Inventors: Christopher W. Lane, Conroe, TX (US); Umesh Prasad, Houston, TX (US); Eric C. Sullivan, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 32 days.

(21) Appl. No.: 17/142,923

(22) Filed: Jan. 6, 2021

(65) Prior Publication Data

US 2022/0213735 A1 Jul. 7, 2022

(51) Int. Cl.

| | |
|---|---|
| ***E21B 10/60*** | (2006.01) |
| ***E21B 10/61*** | (2006.01) |
| ***E21B 10/42*** | (2006.01) |

(52) U.S. Cl.

CPC ..... *E21B 10/602* (2013.01); *E21B 10/42* (2013.01); *E21B 10/61* (2013.01)

(58) Field of Classification Search

CPC ..... E21B 10/602; E21B 10/61; E21B 10/60

See application file for complete search history.

(56) References Cited

U.S. PATENT DOCUMENTS

| | | | | | |
|---|---|---|---|---|---|
| 1,388,490 | A | * | 8/1921 | Suman | E21B 10/60 175/391 |
| 1,476,481 | A | * | 12/1923 | Bashara | E21B 10/42 175/393 |
| 3,544,166 | A | * | 12/1970 | Proctor | E21C 35/1936 299/81.1 |
| 3,555,937 | A | * | 1/1971 | Nicodemas | B23B 51/00 408/59 |
| 4,251,109 | A | * | 2/1981 | Roepke | E21C 35/187 299/12 |
| 4,254,995 | A | | 3/1981 | Guse | |
| 4,280,735 | A | * | 7/1981 | Lobbe | E21C 25/60 299/81.3 |
| 4,303,136 | A | * | 12/1981 | Ball | E21B 10/567 175/393 |
| 4,405,178 | A | * | 9/1983 | Brandenburg | E21C 35/187 251/353 |
| 4,443,038 | A | * | 4/1984 | Brown | E21C 35/187 299/81.1 |

(Continued)

FOREIGN PATENT DOCUMENTS

WO 92/04528 A2 3/1992

OTHER PUBLICATIONS

Dictionary Definition of "proximate", accessed Jun. 28, 2022 via collinsdictionary.com.*

(Continued)

*Primary Examiner* — Blake Michener

(74) *Attorney, Agent, or Firm* — TraskBritt

(57) ABSTRACT

A cutting element may include a fluid passage passing through the cutting element. The cutting element may further include a cutting edge and an aperture proximate the cutting edge. The aperture may be coupled to the fluid passage.

19 Claims, 7 Drawing Sheets

(56) References Cited

U.S. PATENT DOCUMENTS 4,452,324 A * 6/1984 Jurgens ..... E21B 10/567 175/393
4,488,758 A * 12/1984 Clemmow ..... E21B 41/0078 299/81.3
4,534,427 A * 8/1985 Wang ..... B24C 1/04 175/70
4,569,558 A * 2/1986 Hood ..... E21C 35/187 299/16
4,574,895 A * 3/1986 Dolezal ..... E21B 10/567 175/400
4,606,418 A * 8/1986 Thompson ..... E21B 10/567 175/339
4,652,056 A * 3/1987 Parrott ..... E21C 35/187 299/81.3
4,682,663 A * 7/1987 Daly ..... E21B 10/43 175/431
4,765,687 A * 8/1988 Parrott ..... E21C 35/187 299/81.1
4,813,500 A * 3/1989 Jones ..... E21B 10/602 175/379
4,830,123 A * 5/1989 Daly ..... E21B 10/43 175/431
4,852,671 A * 8/1989 Southland ..... E21B 10/5673 175/430
4,902,073 A * 2/1990 Tomlinson ..... E21C 35/183 299/81.1
5,316,095 A * 5/1994 Tibbitts ..... E21B 10/5673 175/429
6,082,223 A 7/2000 Tibbitts
6,986,297 B2 * 1/2006 Scott ..... E21B 10/567 164/132
10,577,869 B2 * 3/2020 Cao ..... B22F 5/00
2003/0019333 A1 * 1/2003 Scott ..... E21B 10/61 76/108.2
2014/0318873 A1 * 10/2014 Patel ..... E21B 10/567 175/432
2015/0233183 A1 * 8/2015 Melsheimer ..... E21B 47/13 175/45
2018/0313163 A1 * 11/2018 Borge ..... E21B 10/61
2018/0334859 A1 * 11/2018 Cao ..... E21B 10/567
2019/0055789 A1 * 2/2019 Azar ..... E21B 10/43
2020/0040661 A1 * 2/2020 Flood ..... E21B 10/5735
2020/0109605 A1 4/2020 Amoudi et al.

OTHER PUBLICATIONS

International Search Report for International Application No. PCT/US2021/072906 dated Apr. 6, 2022, 3 pages.
International Written Opinion for International Application No. PCT/US2021/072906 dated Apr. 6, 2022, 5 pages.

* cited by examiner

EARTH-BORING TOOLS, CUTTING ELEMENTS, AND ASSOCIATED STRUCTURES, APPARATUS, AND METHODS

TECHNICAL FIELD

Embodiments of the present disclosure generally relate to earth-boring operations. In particular, embodiments of the present disclosure relate to earth-boring tools, cutting elements, and associated structures.

BACKGROUND

Wellbore drilling operations may involve the use of an earth-boring tool at the end of a long string of pipe commonly referred to as a drill string. An earth-boring tool may be used for drilling through formations, such as rock, dirt, sand, tar, etc. In some cases, the earth-boring tool may be configured to drill through additional elements that may be present in a wellbore, such as cement, casings (e.g., a wellbore casing), discarded or lost equipment (e.g., fish, junk, etc.), packers, etc. In some cases, earth-boring tools may be configured to drill through plugs (e.g., fracturing plugs, bridge plugs, cement plugs, etc.). In some cases, the plugs may include slips or other types of anchors and the earth-boring tool may be configured to drill through the plug and any slip, anchor, and other component thereof.

A fluid may be supplied into the wellbore during the wellbore drilling operation. The fluid may be used to cool and/or clean the earth-boring tool and/or related cutting elements. For example, the fluid may cool the earth-boring tool and carry cuttings and debris away from the earth-boring tool. Fluid pressure in the wellbore may be controlled to different pressures for different types of drilling operations. For example, in overbalanced drilling, the fluid pressure in the wellbore may be maintained above the pressure of the fluid in the earth formation to substantially prevent ingress of the fluids from the formation into the wellbore during the drilling operation. In some cases, termed "underbalanced" drilling, the fluid pressure in the wellbore may be maintained below the fluid pressure of the formation. Lower fluid pressures may increase the efficiency of the drilling operation, however, this may allow fluid from the formation to enter the wellbore.

BRIEF SUMMARY

Embodiments of the present disclosure may include a downhole cutting element. The cutting element may include a cutting face defined by a surrounding edge. The cutting element may further include a fluid passage through the cutting element. The cutting element may also include an aperture defined in the cutting face proximate the edge, the aperture operatively coupled to the fluid passage.

Another embodiment of the present disclosure may include an earth-boring tool. The earth-boring tool may include a tool body. The earth-boring tool may further include a cutting element coupled to the tool body. The cutting element may include a cutting edge and an aperture proximate the cutting edge. The earth-boring tool may also include a fluid passage coupled between the fluid supply in the tool body and the aperture.

Another embodiment of the present disclosure may include a cutting element. The cutting element may include a fluid passage passing through the cutting element. The cutting element may further include a cutting edge and an aperture proximate the cutting edge. The aperture may be coupled to the fluid passage, and having a major cross-sectional dimension less than a major cross-sectional dimension of the fluid passage.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

The illustrations presented herein are not meant to be actual views of any particular earth-boring system or component thereof, but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, at least about 99% met, or even at least about 100% met. In another example, an angle that is substantially met may be within about +/−15°, within about +/−10°, within about +/−5°, or even within about 0°.

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical" and "lateral" refer to the orientations as depicted in the figures.

During a drilling operation fluid may be supplied into the wellbore to cool and/or clean the earth-boring tool and related cutting elements. The pressure of the fluid in the wellbore may be used to substantially prevent reservoir fluids (e.g., fluids stored in the formation, such as gas, oil, water, etc.) from entering the wellbore during the drilling operation, this is commonly referred to as overbalance drilling. High fluid pressured in the wellbore may reduce the efficiency of the drilling operation. For example, maintaining the fluid pressure above the pressure of the reservoir fluids may increase the strength of the formation near the wall of the wellbore. The increased strength of the formation may reduce the efficiency of the drilling operation by reducing the cutting depth and rate of penetration (ROP) of the earth-boring tool.

Figure 1:
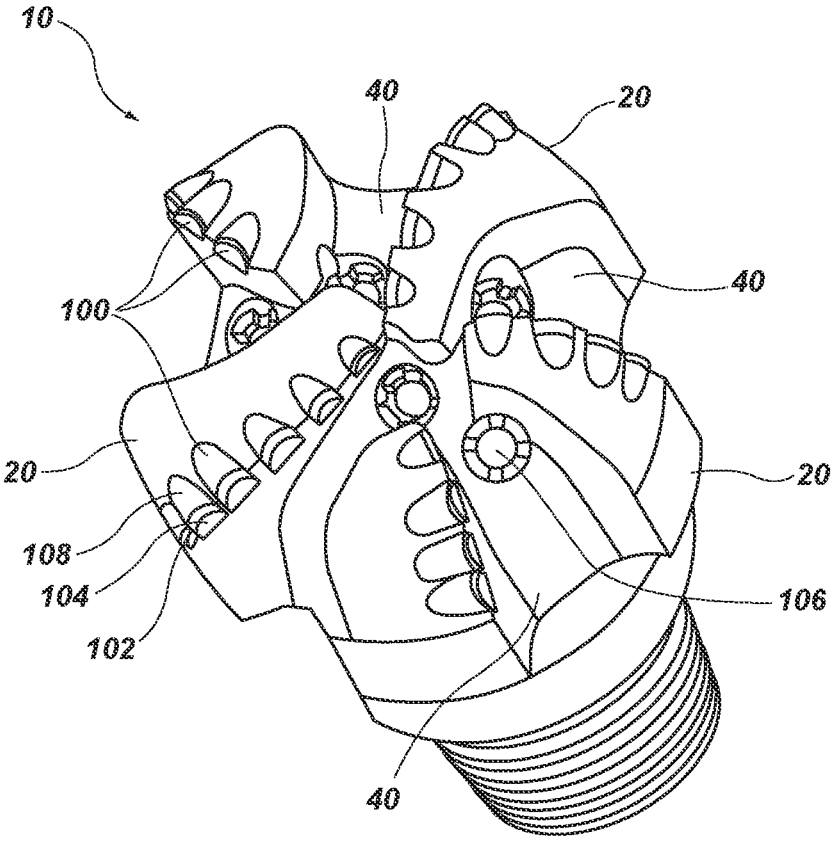
FIG. 1 illustrates a perspective view of an earth-boring tool in accordance with an embodiment of the present disclosure.

Referring to FIG. 1, a perspective view of an earth-boring tool 10 is shown. The earth-boring tool 10 may have blades 20 in which a plurality of cutting elements 100 may be secured. The cutting elements 100 may have a cutting table 102 with a cutting face 104 which may form the cutting edge of the blade 20. The cutting elements 100 may also include a substrate 108 configured to support the cutting table 102. The substrate 108 may be secured to a cutting pocket in the blade 20, such as through welding, soldering, brazing, etc., securing the cutting elements 100 to the blade 20.

The earth-boring tool 10 may rotate about a longitudinal axis of the earth-boring tool 10. When the earth-boring tool 10 rotates the cutting face 102 of the cutting elements 100 may contact the earth formation and remove material. The material removed by the cutting faces 102 may then be removed through the junk slots 40. The earth-boring tool 10 may include nozzles 106 which may introduce fluid, such as water or drilling mud, into the area around the blades 20 to aid in removing the sheared material and other debris from the area around the blades and/or to cool the cutting elements 100 and the blade 20 to increase the efficiency of the earth-boring tool 10.

The fluid may enter the wellbore through the nozzles 106. The nozzles 106 may be coupled to a pressurized fluid supplied through the drill string. The pressure of the fluid in the borehole may be controlled through the pressure of the fluid being supplied through the drill string and the nozzles 106. One or more of the cutting elements 100 may be configured to inject fluid into the formation in a manner that may weaken the formation near the wall of the wellbore to counteract the strengthening effects of the fluid pressure in the wellbore. In some embodiments, the fluid injected through the one or more cutting elements 100 may be the same fluid that is supplied to the nozzles 106. In some embodiments, a separate fluid may be supplied to the cutting element 100 through the earth-boring tool 10 and/or the drill string.

In some embodiments, a select number of the cutting element 100 may be configured to inject the fluid into the formation. For example, one cutting element 100 on each blade 20 may be configured to inject the fluid into the formation. In some embodiments, each of the cutting elements 100 in a nose region of the earth-boring tool 10 may be configured to inject the fluid into the formation. In some embodiments, only one or two of the cutting elements 100 may be configured to inject the fluid into the formation. For example, a cutting element 100 on a first blade 20 may be configured to inject the fluid into the formation, substantially weakening the formation for the cutting elements 100 on each of the following blades. In some embodiments, a second blade 20 positioned opposite the first blade 20 may include a second cutting element 100 configured to inject the fluid, such that at least two cutting elements 100 are configured to inject the fluid weakening the formation for the subsequent cutting elements 100. In some embodiments, the cutting elements 100 configured to inject the fluid may be arranged at different positions along the respective blades. For example, as the earth-boring tool 10 rotates, the cutting elements 100 configured to inject the fluid on each adjacent blade 20 may travel in different paths, such that the fluid may be injected into the formation along different paths from each blade 20 of the earth-boring tool 10.

Figure 2:
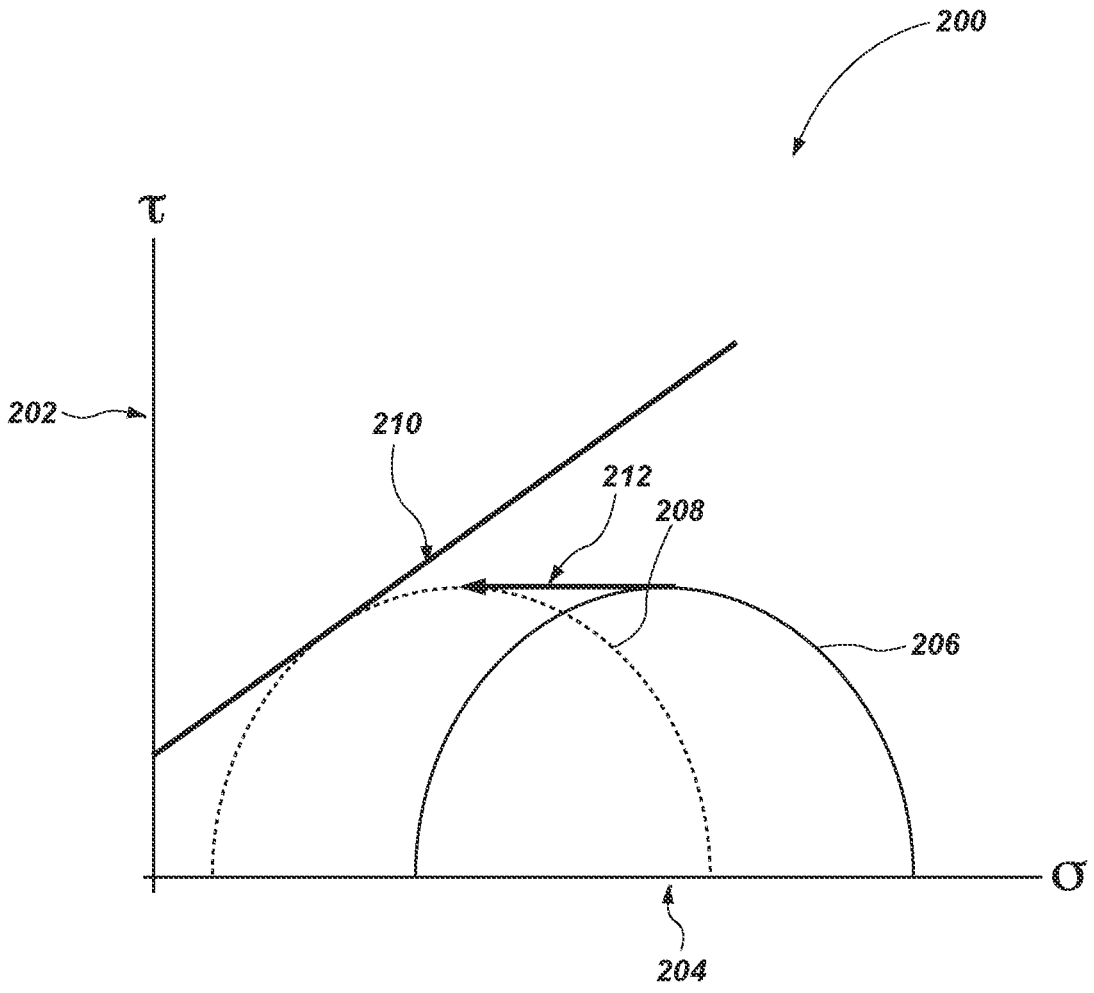
FIG. 2 illustrates a graphical representation of stresses in an earth formation under different conditions.

FIG. 2 illustrates a graph 200 representative of the stresses experienced by the formation in an overbalanced drilling operation. The graph 200 further illustrates the effect of pore fluid pressure on the effective stress experienced by the formation. In particular the graph 200 illustrates representations of the shear stress 202 of the formation with respect to the normal stress 204 of the formation under different conditions. A first curve represents the total stress 206 of the formation and a second curve represents the effective stress 208 of the formation under the pore pressure effect 212.

The pore pressure effect 212 is caused by increasing pore fluid pressure, such as by injecting fluid into the formation as described above. Increasing pore fluid pressure beyond the in-situ pore pressure reduces the normal principle stresses without diminishing the shear stress. This effect may change the total stress field of the formation without changing a failure envelope 210. Changing the total stress field of the formation without changing the failure envelope 210 may encourage fracture in the formation by increasing the ratio of shear stress 202 to normal stress 204. The change in the normal stress 204 caused by the pore pressure effect 212 may be represented by the following formula:

$$\sigma' = \sigma - u$$

Where $\sigma'$ represents effective stress, $\sigma$ represents total stress, and $\mu$ represents pore pressure. The pore pressure $\mu$ may be scaled by Biot's constant $\alpha$, which is a scalar representative of the porosity of the formation. This scalar may be directly proportional to porosity; approaching zero with porosity, and approaching one as porosity approaches 100%.

The effective stress may be reduced by the increase in pore pressure by reducing the ratio of the fluid pressure in the wellbore (e.g., wellbore pressure) to the fluid pressure in the formation 308 (e.g., pore pressure). Reducing the ratio of wellbore pressure to pore pressure at the area where the earth-boring tool 10 engages the formation 308, may preserve borehole integrity while reducing the strength of the formation 308 at the specific location where the earth-boring tool 10 is engaged with the formation 308. For example, increasing pore pressure at the location where the earth-boring tool 10 engages the formation 308 may encourage crack opening in the formation 308, may reduce the stress at which the maximum shear stress threshold is reached for the formation 308, and may locally reduce the strengthening effect of overbalanced drilling on the formation 308.

Figure 3:
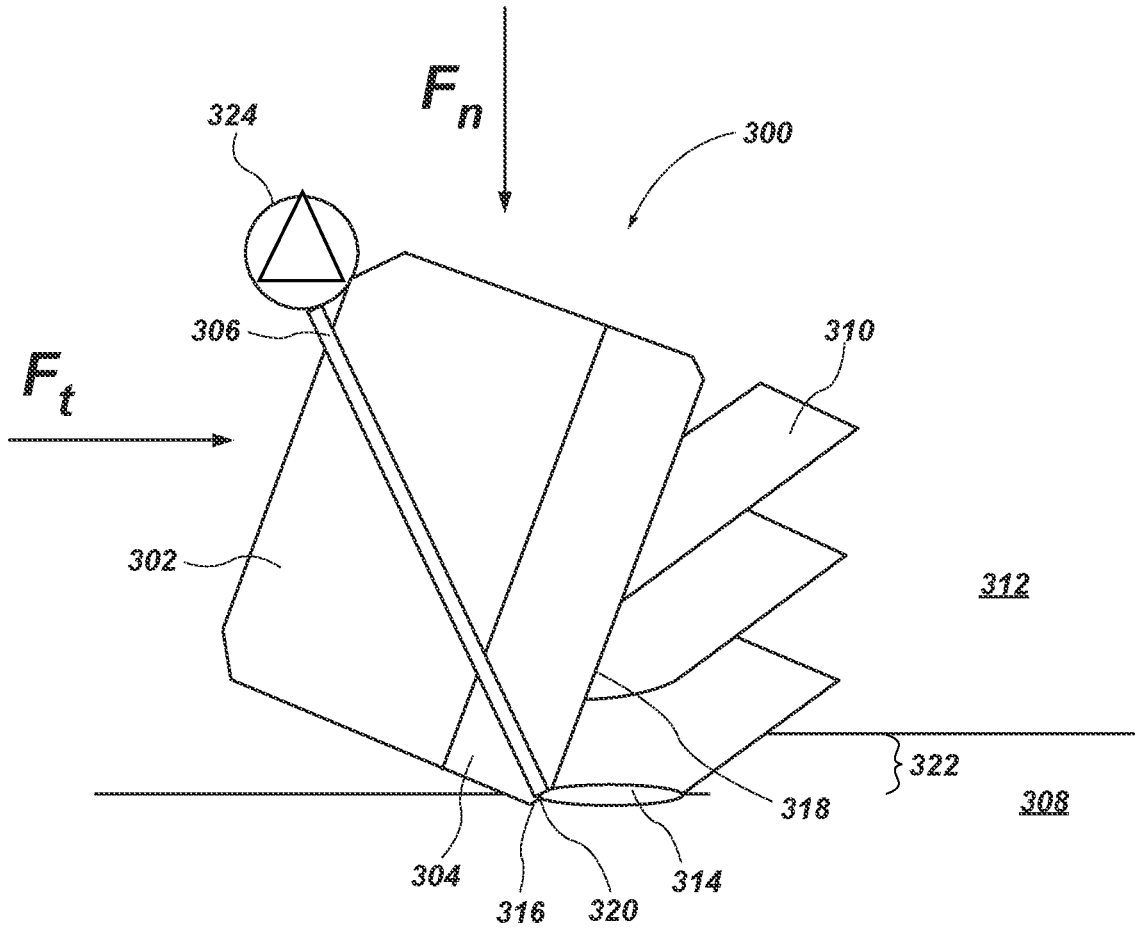
FIG. 3 illustrates schematic view of a cutting element in accordance with an embodiment of the present disclosure.

FIG. 3 illustrates a schematic view of a cutting element 300 configured to inject a fluid into a formation 308. The cutting element 300 may include a substrate 302 and a cutting table 304. A fluid passage 306 may be defined through the cutting element 300. The fluid passage 306 may pass through the substrate 302 of the cutting element 300 into the cutting table 304 of the cutting element 300 and out through a cutting face 318 of the cutting table 304. The fluid passage 306 may pass out of the cutting element 300 through the cutting face 318 of the cutting table 304 in an area near a cutting edge 316 of the cutting face 318. The cutting edge 316 may be a portion of an edge formed between a side of the cutting table 304 and the cutting face 318 of the cutting table 304. The cutting edge 316 may be the portion of the edge proximate the formation 308, such that the cutting edge 316 may engage the formation 308 at a wall of the wellbore 312.

The cutting face 318 of the cutting table 304 may include a transition region 320 between the cutting face 318 and the edge between the cutting face 318 and the side of the cutting table 304. For example, the transition region 320 may include a chamfer or radius transitioning between the cutting face 318 and a side of the cutting table 304. The fluid passage 306 may pass out of the cutting element 300 through the transition region 320 of the cutting face 318. In some embodiments, where the transition region 320 is a chamfer or other substantially planar surface, the fluid passage 306 may be positioned such that the fluid passage 306 is substantially normal to (e.g., perpendicular to, transverse to, orthogonal to, etc.) the surface of the cutting face 318 in the transition region 320.

A fluid 314 may pass through the fluid passage 306 exiting the fluid passage 306 through the cutting face 318. As described above, the fluid 314 may exit the cutting face 318 in the transition region 320 proximate the cutting edge 316. As illustrated in FIG. 3, the cutting edge 316 and the cutting face 318 may be actively engaged with the formation 308, such that the cutting element 300 may be removing material from the formation 308 in the form of cuttings 310. The fluid 314 may be injected into the formation 308 near the cutting edge 316 of the cutting element 300. The fluid 314 may weaken the formation 308 in the region of the formation 308 proximate cutting edge 316 (e.g., the wall of the wellbore 312).

In some embodiments, the earth-boring tool 10 may include an additional pump 324. The pump 324 may be configured to increase a pressure of the fluid 314 before passing the fluid 314 through the fluid passage 306. For example, the fluid 314 may be the drilling fluid supplied through the drill string, such as drilling mud. The pump 324 may boost the pressure of the fluid from the fluid supply, such as to supply a greater pressure into the formation 308. For example, the pump 324 may pressurize the fluid 314 to a pressure greater than about 1000 pounds per square inch (psi) (6,895 kilopascals (kPa)), such as between about 1000 psi (6,895 kPa) and about 2000 psi (13,790 kPa), or between about 1200 psi (8,274 kPa) and about 1,500 psi (10,342 kPa). In some embodiments, the earth-boring tool 10 may not include the pump 324 and the fluid 314 may pass through the fluid passage 306 and into the formation 308 under the pressure of the drilling fluid from the drill string. In some embodiments, the fluid 314 may be a separate fluid from the drilling fluid. For example, a separate fluid may be supplied through the drill string or a fluid reservoir may be included in the earth-boring tool 10 or drill string.

In some embodiments, the pump 324 may be positioned within the earth-boring tool 10. For example, the earth-boring tool 10 may include a cavity coupled to a flow path of the fluid. The pump 324 may be positioned within the cavity and coupled to the fluid passage 306. In other embodiments, the pump 324 may be positioned outside the earth-boring tool 10. For example, the pump 324 may be positioned within the drill string or as a module adjacent to the shank of the earth-boring tool.

As the cutting element 300 engages the formation 308, the earth-boring tool 10 may exert forces on the cutting element 300 in at least two directions. The earth-boring tool 10 may exert a normal force $F_n$ in a direction transverse (e.g., normal, perpendicular, etc.) to the wall of the wellbore 312 and a tangential force $F_t$ in a direction substantially parallel to the wall of the wellbore 312. The normal force $F_n$ may be proportional to the weight on bit (WOB) exerted on the earth-boring tool 10 by an associated drill string or drilling assembly. The tangential force $F_t$ may be proportional to the rotational force exerted on the earth-boring tool 10 by the associated drill string and/or motor (e.g., downhole motor, mud motor, etc.). The normal force $F_n$ may push the cutting element 300 into the formation 308 to a depth represented as the depth of cut 322. The depth of cut 322 may be proportional to the rate of penetration (ROP) of the earth-boring tool 10. The depth of cut 322 may increase under the same normal force $F_n$ as the formation 308 is weakened. Increasing the depth of cut 322 and the ROP may increase the speed with which the earth-boring tool 10 drills through a formation. Increasing the speed with which the earth-boring tool 10 drills through the formation under substantially the same forces may represent an increase in efficiency of the earth-boring tool 10.

Figure 4:
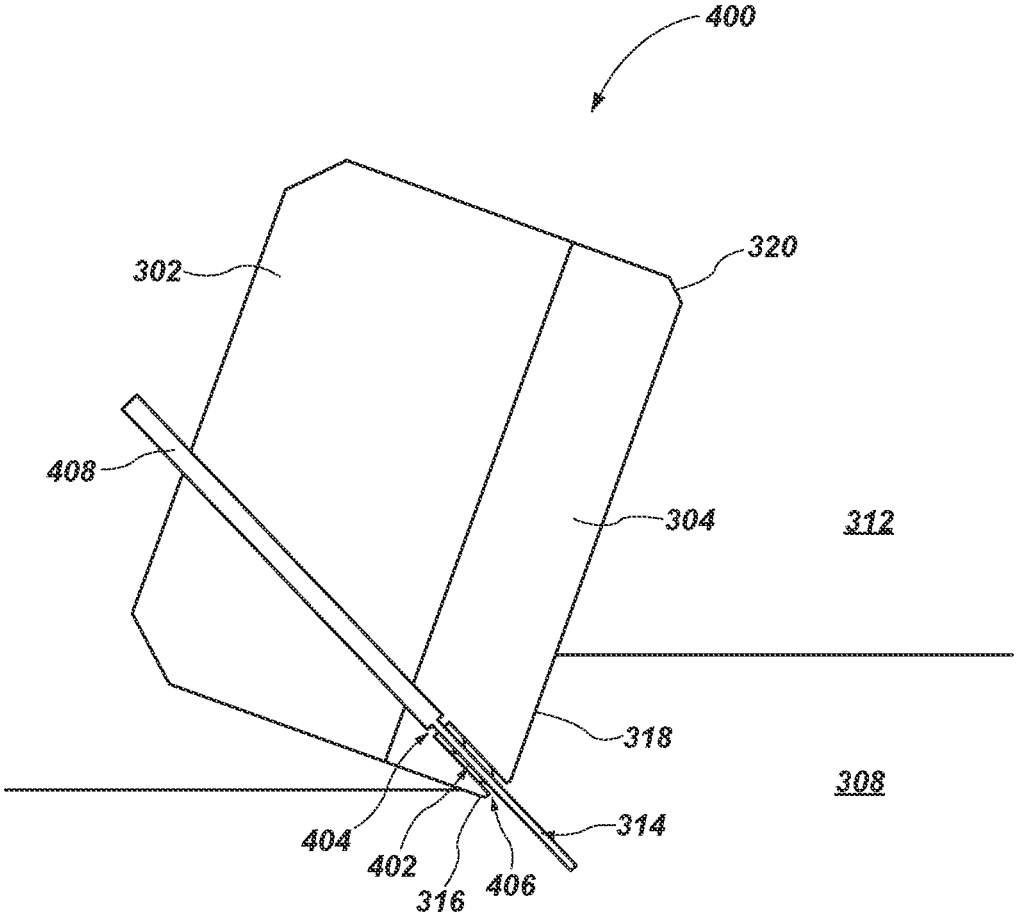
FIG. 4 illustrates schematic view of a cutting element in accordance with an embodiment of the present disclosure.

FIG. 4 illustrates an embodiment of a cutting element 400 configured to inject a fluid 314 into the formation 308. As described above, the cutting element 400 may a fluid passage 408 passing through the substrate 302 and the cutting table 304. The cutting table 304 may include an orifice 404 at an end of the fluid passage 408. As used herein, an orifice means and includes a hole or aperture in a wall separating two fluid volumes, such as fluid passageways, fluid filled cavities, etc., such that fluid may pass from one fluid volume to another through the orifice. The end of the fluid passage 408 and the orifice 404 may be positioned within the cutting table 304 before the cutting face 318. The orifice 404 may have a major cross-sectional dimension (e.g., diameter, radius, apothem, width, etc.) that is less than a major cross-sectional dimension of the fluid passage 408. For example, the orifice 404 may be circular and may have a diameter of between about 0.2 inches (in) (5.08 millimeters (mm)) and about 0.05 in (1.27 mm), such as between about 0.1 in (2.54 mm) and about 0.15 in (3.81 mm). The orifice 404 may be configured to concentrate the flow of the fluid 314 to form a jet. Concentrating the flow of the fluid 314 may cause the fluid to accelerate such that the jet of the fluid 314 is traveling at a higher rate of speed and has a smaller cross-sectional area than the fluid 314 within the fluid passage 408.

The cutting face 318 may include an aperture 406 extending into the cutting table 304 and connected to the orifice 404. A nozzle 402 may be disposed within the aperture 406. In some embodiments, the nozzle 402 may be secured in the aperture 406 with a mechanical connection, such as a threaded connection, an interference connection, etc. In some embodiments, the nozzle 402 may be secured in the aperture 406 with an adhesive connection, such as with a glue or epoxy. In some embodiments, the nozzle 402 may be secured in the aperture 406 through a high temperature process, such as welding, brazing, or soldering.

The nozzle 402 may be configured to concentrate the flow the fluid 314. For example, the nozzle 402 may be configured to further concentrate the flow of the fluid 314 after the concentration created by the orifice 404. In some embodiments, the nozzle 402 may be configured to maintain the concentration of the flow of the fluid 314 from the orifice 404. In some embodiments, the nozzle 402 may replace the orifice 404. The nozzle 402 may be positioned within the aperture 406, such that a tip of the nozzle 402 is proximate the opening of the aperture 406 (e.g., proximate the cutting face 318). The jet of the fluid 314 may exit the tip of nozzle 402 at the higher rate of speed and with the smaller cross-sectional area resulting from the flow concentration of the orifice 404 and/or the nozzle 402. The fluid 314 may imping upon the formation 308 and the higher rate of speed and the smaller cross-sectional area may enable the fluid 314 to penetrate a greater distance into the formation 308.

The aperture 406 may be defined in the cutting table 304, such that the opening of the aperture 406 in the cutting face 318 may be proximate the cutting edge 316. As described above, the opening of the aperture 406 may be defined in the transition region 320 proximate the cutting edge 316. The aperture 406 may be positioned such that the flow of the fluid 314 is substantially perpendicular to the cutting face 318 in the area of the aperture 406. As illustrated in FIG. 4, where the aperture 406 is defined in the transition region 320 of the cutting face 318, the aperture 406 may be positioned such that the flow of the fluid is in a direction substantially perpendicular to the cutting face 318 in the transition region 320. Directing the fluid 314 in a direction substantially perpendicular to the cutting face 318 in the transition region 320 may direct the fluid 314 at a different angle relative to the cutting face 318 outside of the transition region 320. The direction of the flow of the fluid 314 may create deeper penetration into the formation 308, weakening the formation 308 at a greater depth. In some embodiments, the direction of the flow of the fluid 314 may substantially prevent debris from blocking the aperture 406.

The fluid passage 408, orifice 404, and aperture 406 may be formed in the cutting element 300 through a material removal process. For example, the material may be removed through a laser ablation process. In some embodiments, the fluid passage 408, orifice 404, or aperture 406 may be formed from an acid dissolvable material within the cutting element 400 when the cutting element 400 is formed. The acid dissolvable material may then be removed with an acid. In some embodiments, multiple processes may be used to form the fluid passage 408, orifice 404, and aperture 406. For example, the fluid passage 408 through the substrate 302 may be formed through laser ablation and the aperture 406 and orifice 404 in the cutting table 304 may be formed through an acid dissolving process.

Figure 5:
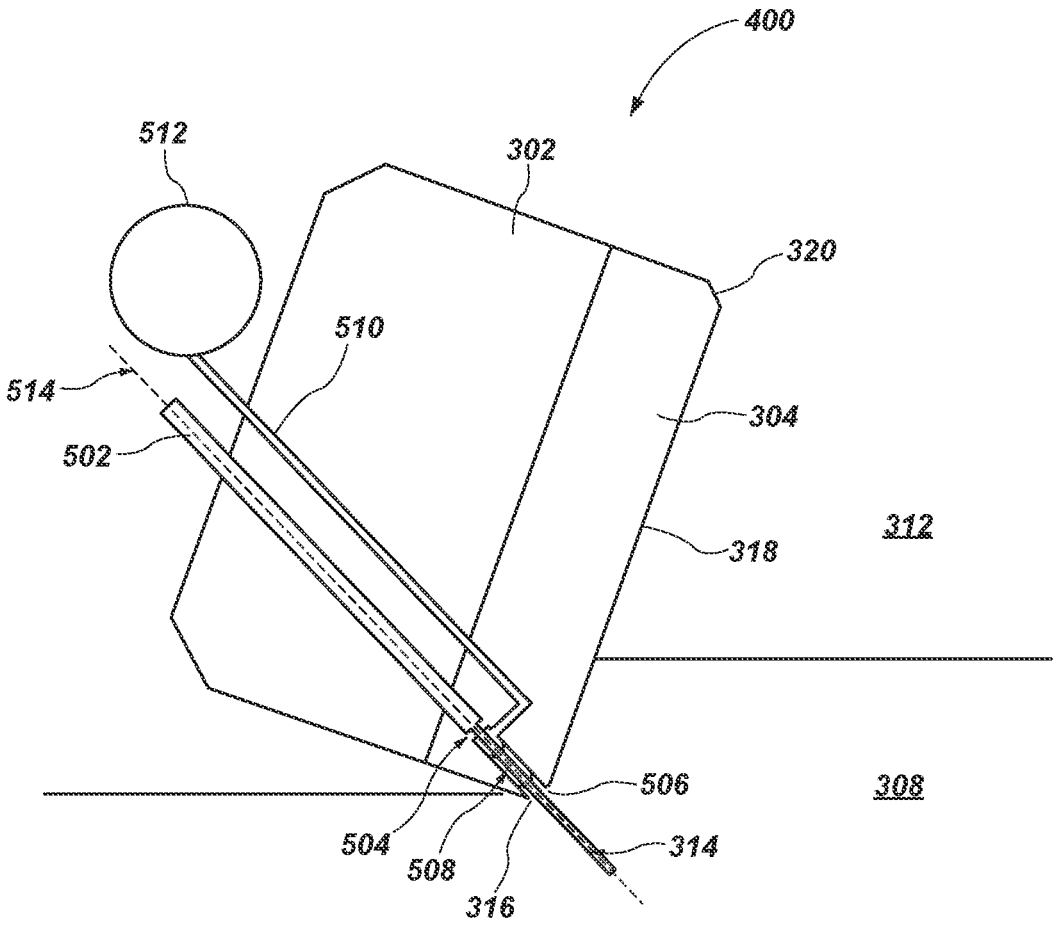
FIG. 5 illustrates schematic view of a cutting element in accordance with an embodiment of the present disclosure.

FIG. 5 illustrates another embodiment of a cutting element 500 configured to inject a fluid 314 into the formation 308. Similar to the embodiments described above, the cutting element 500 may include a fluid passage 502 defined through the substrate 302 and the cutting table 304 of the cutting element 500. The fluid passage 502 may include an orifice 504 at an end of the fluid passage 502 within the cutting table 304. The fluid passage 502 may be coupled to an aperture 506 in the cutting face 318 of the cutting table 304. The aperture 506 may include a nozzle 508 disposed within the aperture 506, such that a tip of the nozzle 508 is proximate the cutting face 318. As described above, the aperture 506 may be defined in the transition region 320 between the cutting face 318 and the cutting edge 316.

The orifice 504 may have a major cross-sectional dimension that is less than the major cross-sectional dimension of the fluid passage 502. As described above, the orifice 504 may be configured to concentrate the flow of the fluid 314 into a jet as the fluid 314 leaves the fluid passage 502.

The cutting element 500 may include an abrasive inlet tube 510. The abrasive inlet tube 510 may be coupled to an abrasive reservoir 512. The abrasive reservoir 512 may contain abrasive particles, such as silica particles, sand particles, diamond particles, etc. In some embodiments, the abrasive reservoir 512 may be enclosed within the cutting element 500. For example, the abrasive reservoir 512 may be a cavity defined within the cutting element 500. In some embodiments, the abrasive reservoir 512 may be enclosed within the earth-boring tool 10, such as within a blade 20 of the earth-boring tool 10 or within the body of the earth-boring tool 10. In other embodiments, the abrasive reservoir 512 may be housed outside the earth-boring tool 10, such as in a module or in the drill string.

The abrasive inlet tube 510 may be coupled to the fluid passage 502 or the aperture 506. The abrasive inlet tube 510 may be arranged to intersect the fluid passage 502 and/or the aperture 506 orthogonally (e.g., perpendicular, transverse, at a 90° angle) to a longitudinal axis 514 of the fluid passage 502 and/or the aperture 506. As illustrated in FIG. 5, the abrasive inlet tube 510 may orthogonally intersect the aperture 506 between the orifice 504 and the nozzle 508. The flow of the fluid 314 may generate a vacuum in the aperture 506 between the orifice 504 and the nozzle 508. For example, as the fluid 314 is accelerated due to the constriction of the orifice 504, the pressure in the region of the aperture 506 between the orifice 504 and the nozzle 508 may be reduced creating a lower pressure than the surrounding regions, such as the abrasive inlet tube 510, through the Venturi effect. Abrasive particles may enter the fluid 314 through the abrasive inlet tube 510 under the influence of the vacuum generated by the flow of the fluid 314.

The fluid 314 with the abrasives may then pass through the nozzle 508 concentrating the flow of the fluid 314 and the abrasives into a jet. The jet of fluid 314 and abrasives may then impinge on the formation 308 near the cutting edge 316. The abrasives may increase the material removing actions of the jet of fluid 314. The increase in material removing actions may enable the fluid 314 to penetrate a greater distance into the formation 308, weakening the formation 308 at a greater depth.

Figure 6:
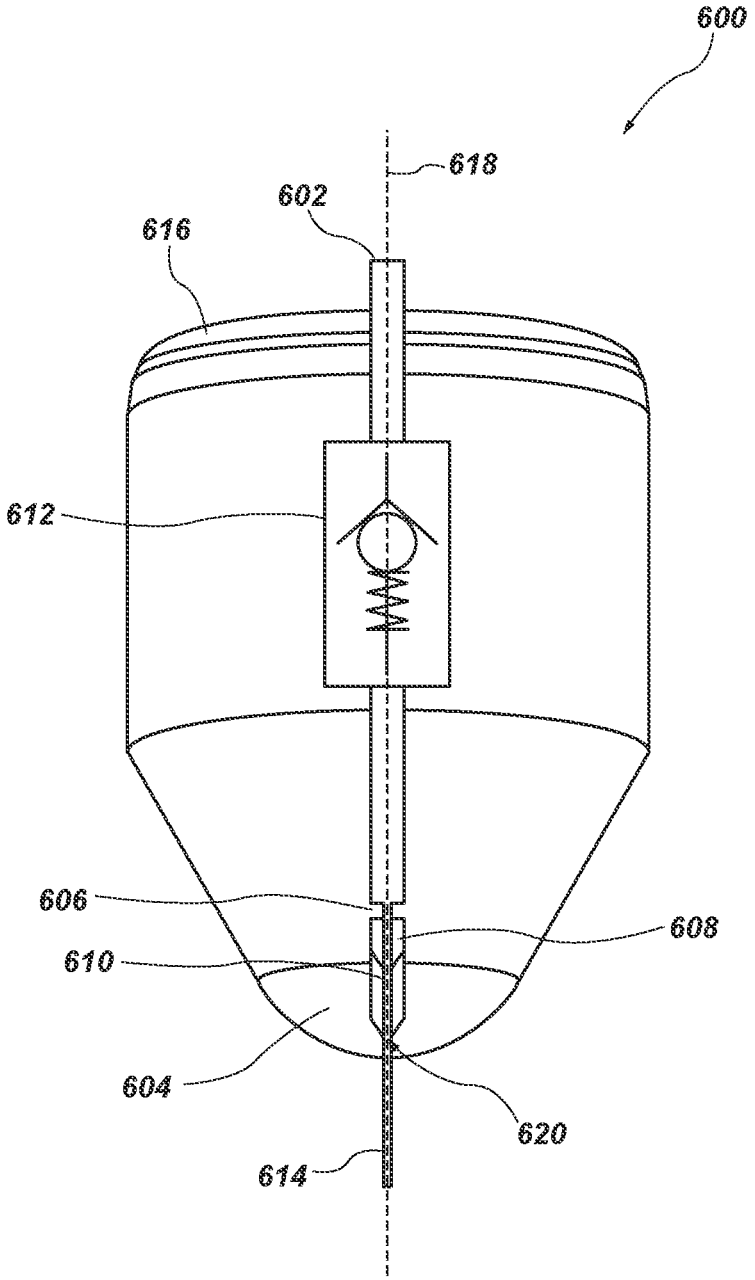
FIGS. 6 and 7 illustrates schematic views of a cutting element in accordance with an embodiment of the present disclosure

FIG. 6 illustrates an embodiment of a cutting element 600, such as a cutting element 600 from a roller cone drill bit. The cutting element 600 may include a fluid passage 602 passing through the cutting element 600. The fluid passage 602 may be defined substantially along a longitudinal axis 618 of the cutting element 600, such that the fluid passage 602 may pass from a base 616 of the cutting element 600 to a tip 604 of the cutting element 600. The fluid passage 602 may include an orifice 606 at an end of the fluid passage 602 configured to concentrate the flow of a fluid 614 through the fluid passage 602 to form a jet of the fluid 614. The fluid passage 602 may be coupled to a cavity 608. The cavity 608 may include nozzle 610 formed therein. The nozzle 610 may be configured to further concentrate the flow of the fluid 614 and/or to maintain the concentrated jet of the fluid 614. In some embodiments, an abrasive inlet tube 510 (FIG. 5) may be included in the cutting element 600 and may inject abrasives into the cavity 608 between the orifice 606 and the nozzle 610 as described above. The tip 604 of the cutting element 600 may include an aperture 620 substantially aligned with the nozzle 610, such that the jet of the fluid 614 may exit the cutting element 600 through the tip 604 at a cutting edge of the cutting element 600 and imping upon the formation 308 (FIG. 3).

A cutting element may not be in constant contact with the formation 308. Therefore, the cutting element 600 may include a valve 612 configured to restrict and/or stop flow of the fluid 614 when the cutting element 600 is not in contact with the formation 308. For example, the valve 612 may be a spring valve configured to open when under pressure (e.g., normal force $F_n$ (FIG. 3), WOB, when the cutting element 600 is in contact with the formation) and close when the pressure is released (e.g., when the cutting element 600 is not in contact with the formation). For example, the cutting element 600 may be a cutting element on a roller cone. As the roller cone rotates the cutting element 600 may contact the formation 308 and then release from the formation 308 until the rotation of the roller cone brings the cutting element 600 back into contact with the formation 308. The valve 612 may cause the cutting element 600 to supply the jet of fluid 614 into the formation 308 when the cutting element 600 is in contact with the formation 308 and may interrupt the flow of the fluid 614 when the cutting element 600 loses contact with the formation 308 (e.g., during the portion of the rotation of the roller cone when the cutting element 600 is not in contact with the formation 308).

Figure 7:
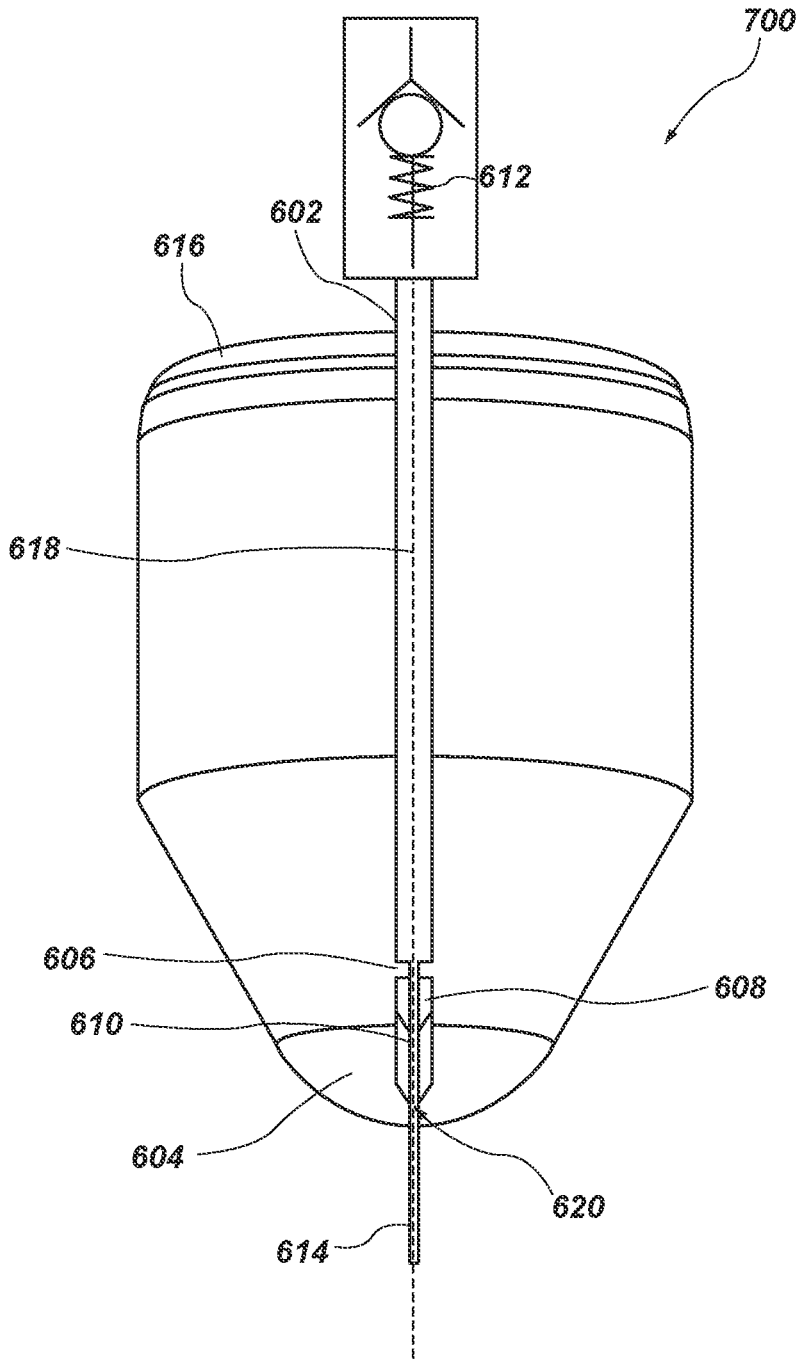

In some embodiments, the valve 612 may be positioned within the cutting element 600. For example, the valve 612 may be positioned in the tip 604 of the cutting element 600 or deeper within the body of the cutting element 600 along the longitudinal axis 618 of the cutting element 600. In some embodiments, the valve 612 may be positioned between the cutting element 600 and the earth-boring tool 10, as illustrated in the cutting element 700 of FIG. 7. For example, the valve 612 may be positioned in a cutter pocket of the earth-boring tool 10 where the fluid passage 602 connects the cutting element 600 to the fluid supplied by the earth-boring tool 10. As the cutting element 600 contacts the formation 308, the pressure may be transferred from the cutting element 600 to the earth-boring tool 10 through the cutter pocket. Therefore, the valve 612 may receive the pressure by being sandwiched between the cutting element 600 and the earth-boring tool 10 in the cutter pocket. When the valve 612 receives the pressure input from the cutting element 600, the valve 612 may open allowing the fluid 614 to flow from the earth-boring tool 10 into the cutting element 600 and out the aperture 620 into the formation 308.

The valve 612 may enable multiple cutting elements 600 to be configured to supply the fluid 614 into the formation 308 while only allowing the fluid 614 to flow out of a select number of the cutting elements 600 at one time. Limiting the number of cutting elements 600 flowing fluid 614 at one time may reduce the requirements (e.g., size, power, etc.) of any associated pump (e.g., pump 324 (FIG. 3)) and/or fluid supply line.

Embodiments of the present disclosure may cause the pore pressure in a formation to be artificially increased in a controlled area. Increasing the pore pressure of the formation may reduce the forces required to shear the formation and remove the material from the formation. This may reduce the power required to remove the material, reducing the power used in a drilling operation and/or increasing the speed with which the drilling may be performed. Controlling the area where the pore pressure of the formation is artificially increased may enable a drilling operation to maintain the integrity of the wellbore through overbalanced drilling in the majority of the wellbore, while weakening the wall of the wellbore in a localized area to increase the efficiency of the material removal process. Increasing the efficiency of the material removal process may reduce the cost of drilling a wellbore. Increasing the efficiency of the material removal process may further reduce the amount of time before a wellbore may begin production and become a profitable wellbore.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A downhole cutting element, comprising:

a cutting table including a cutting face defined by a surrounding edge;

a fluid passage extending through the cutting element;

an aperture defined in the cutting face proximate the edge, the aperture operatively coupled to the fluid passage through an orifice, the orifice having a major cross-sectional dimension smaller than a major cross-sectional dimension of the fluid passage and smaller than a major cross-sectional dimension of the aperture; and an abrasive particle inlet tube coupled between an abrasive particle reservoir and the aperture.

2. The downhole cutting element of claim 1, wherein the cutting face comprises a transition region between the cutting face and the edge.

3. The downhole cutting element of claim 2, wherein the aperture is defined in the transition region of the cutting face.

4. The downhole cutting element of claim 3, wherein the aperture extends into the cutting element in a direction substantially orthogonal to the cutting face in the transition region.

5. The downhole cutting element of claim 1, wherein the major cross-sectional dimension of the aperture is smaller than the major cross-sectional dimension of the fluid passage.

6. The downhole cutting element of claim 5, wherein the major cross-sectional dimension of the aperture is defined by a nozzle disposed within the aperture.

7. The downhole cutting element of claim 6, wherein the nozzle is positioned within the aperture such that a body of the nozzle is disposed within a cutting table of the cutting element and a tip of the nozzle is proximate the cutting face.

8. The downhole cutting element of claim 1, wherein the orifice is defined at an end of the fluid passage within a cutting table of the cutting element, the orifice positioned between the fluid passage and the aperture.

9. The downhole cutting element of claim 1, wherein the abrasive inlet tube is positioned between an end of the fluid passage and the cutting face.

10. The downhole cutting element of claim 1, wherein the abrasive inlet tube intersects the aperture at an angle substantially orthogonal to a longitudinal axis of the aperture.

11. An earth-boring tool comprising:

a tool body;

a cutting element coupled to the tool body, the cutting element including:

a cutting table defining a cutting edge; and an aperture proximate the cutting edge;

a fluid passage defined in the cutting element coupled between a fluid passage through the tool body and the aperture;

an abrasive reservoir coupled to the fluid passage defined in the cutting element through an abrasive inlet tube; and an orifice coupling the fluid passage to the aperture, the orifice having a major cross-sectional dimension less than a major cross-sectional dimension of the fluid passage and smaller than a major cross-sectional dimension of the aperture.

12. The earth-boring tool of claim 11, further comprising a pump coupled between the fluid passage through the tool body and the fluid passage.

13. The earth-boring tool of claim 11, further comprising a valve configured to selectively interrupt fluid flow in the fluid passage.

14. The earth-boring tool of claim 13, wherein the valve comprises a spring valve configured to selectively interrupt the flow in the fluid passage based on a pressure exerted on the cutting element.

15. The earth-boring tool of claim 13, wherein the valve is positioned between the cutting element and the tool body.

16. The earth-boring tool of claim 13, wherein the valve is positioned within the cutting element.

17. A cutting element comprising:

a fluid passage passing through the cutting element;

a cutting table defining a cutting edge, including a formation engaging portion of the cutting edge; and an aperture extending through the formation engaging portion of the cutting edge, the aperture coupled to the fluid passage;

an abrasive inlet tube coupled between an abrasive reservoir and the aperture; and a nozzle disposed within the aperture, the nozzle having a major cross-sectional dimension less than a major cross-sectional dimension of the fluid passage.

18. The cutting element of claim 17, the fluid passage further comprising a valve configured to selectively prevent flow of a fluid through the fluid passage.

19. The cutting element of claim 18, wherein the valve comprises a spring valve configured to selectively prevent flow of the fluid based on a pressure exerted on the cutting element.

* * * * *